United States Patent [19]

Stull

[11] 4,438,870

[45] Mar. 27, 1984

[54] CAPTIVE DISPENSING CAP CONSTRUCTION

[76] Inventor: Morton Stull, Split Rock Rd., Boonton Township, Morris County, N.J. 07005

[21] Appl. No.: 265,384

[22] Filed: May 20, 1981

[51] Int. Cl.[3] ..... B65D 47/20

[52] U.S. Cl. ..... 222/48; 222/521

[58] Field of Search ..... 222/519, 520, 521

[56] References Cited

U.S. PATENT DOCUMENTS

| | | | |
|---|---|---|---|
| 3,370,764 | 2/1968 | Stull | 222/521 X |
| 3,406,880 | 10/1968 | Stull | 222/521 |
| 3,844,455 | 10/1974 | Stull | 222/525 |

*Primary Examiner*—Joseph J. Rolla
*Assistant Examiner*—Frederick R. Handren
*Attorney, Agent, or Firm*—H. Gibner Lehmann; K. Gibner Lehmann

[57] ABSTRACT

A captive dispensing cap construction for a container, comprising a body part having a discharge passage, and a stopper extending upwardly from the passage. A screw cap part is carried by the body part and has a discharge opening into which the stopper extends when the screw cap part is screwed to its full-on position. The screw cap part and body part have two pairs of mutually engageable portions, one comprising cooperable screw threads for moving the screw cap part axially on the body part as the cap part is turned, and the other comprising a cam track on the body part and a follower portion on the screw cap part. The screw threads have sufficient backlash to enable the screw cap part to have an initial unscrewing turning movement from its fully screwed-on position through an angle essentially in excess of 20° before axial outward displacement of the cap part occurs. The initial rotation without axial displacement operates to loosen previously crusted product from the screw cap part, since the stopper tends to retain part of the crusted product during such initial rotation. Thereafter, the axial movement of the cap forcibly loosens such crusted product from both the screw cap part and the stopper.

16 Claims, 16 Drawing Figures

CAPTIVE DISPENSING CAP CONSTRUCTION

BACKGROUND

This invention relates to dispensing cap constructions of the type intended to dispense liquid or cream products, and more particularly to constructions of the kind incorporating a screw cap having a discharge passage which is sealed by a stopper on a cap body.

In particular, the invention involves improvements in applicant's U.S. Pat. Nos. 3,598,285; 3,844,455; and 3,848,779.

All of the cap constructions disclosed and described in the above patents are of the same general type, as far as their operation and use are concerned. In particular, each device comprises a screw cap having a discharge passage which is carried on a cap body having an upstanding spout, which in turn carries a sealing pin or stopper that is receivable in the discharge opening of the screw cap.

While the above patented constructions operated in a generally satisfactory manner, a number of problems have been found to occur when dispensing certain types of products, particularly glues, adhesives, and the like.

Referring to the device shown in U.S. Pat. No. 3,848,779, there was a tendency, following the first few uses of the dispenser, for crusted product (glue) to harden over the area around the stopper or plug 20 and the surrounding area of the external surface of the screw cap 12. During subsequent use, as the cap 12 was unscrewed from the position shown in FIG. 1 to that shown in FIG. 7, the crusted product tended to adhere to the external surface of the cap, forming a dome over the discharge passage 26, this dome remaining sealed and intact, in many cases. As a result, further discharge of product through the opening 26 was prevented, and it was necessary to forcibly dislodge the dome, either with a flick of the user's nail, or by means of a suitable instrument or knife. Naturally, where the dispenser was being used frequently this represented an unnecessary waste of time, whereby the convenience of the dispenser was impaired somewhat.

The other alternative would be to wipe the stopper or plug 20 and surrounding surface of the cap 12 after each use, which was considered a nuisance from the standpoint of the consumer. Accordingly, the problem of product formation over the opening 26 arose from the fact that hardened glue tended to cling to the outer surface of the cap, and not to the plug 20, the latter having a relatively smooth cylindrical surface which tended to readily release hardened product without tending to cause it to break away.

The above disadvantages and drawbacks of prior dispensing cap constructions are obviated by the present invention which has for an object the provision of a novel and improved cap construction which is simple in its structure, reliable in use, and which greatly minimizes the tendency for crusted product to adhere to the surface of the cap and thus interfere with subsequent dispensing operations.

A related object of the invention is to provide a dispensing cap construction as above, wherein the parts can be readily molded of plastic, in relatively simple mold cavities.

A still further object is to provide a dispensing cap construction of the type having a turnable screw cap, wherein the cap can, from its full-on position, rotate through an angle on the order of 20° or more prior to experiencing any outward axial movement, thereby intending to loosen any residual hardened product on its exterior surface adjacent its discharge opening.

Still another object is to provide a cap construction of the type having a stopper which is receivable in the discharge passage of a screw cap, wherein the stopper has a surface configuration of a generally non-smooth nature that tends to hold residual hardened product during initial rotation of the screw cap, thus causing breakage of the crust from the surface of the cap surrounding its opening.

Yet another object is to provide a screw cap construction which has a long life expectancy, and which lends itself to assembly by automatic capping equipment.

The above objects are accomplished by the provision of a captive dispensing cap construction comprising a tubular body part having a discharge passage and a stopper extending upwardly from the passage, and a screw cap part carried by the body part and having a discharge opening into which the stopper extends when the screw cap part is screwed to its full-on position. The screw cap and body parts have two pairs of mutually engageable portions, one pair comprising cooperable screw thread means for moving the screw cap part axially on the body part as the screw cap part is turned, and the other comprising a cam track on the body part and a follower portion on the screw cap part. A lug is disposed on the screw cap part, and there is a stop shoulder on the body part, engageable with the lug of the screw cap part to halt its turning as it is screwed to its full-on position. The screw thread means of the screw cap and body parts have sufficient backlash to enable the screw cap part to have an initial unscrewing turning movement from its fully screwed-on position without outward axial displacement, through an angle essentially in excess of 20°. The stopper has an exposed surface configuration which tends to retain hardened or crusted product against dislodgement during the initial rotating movement until a forcible removal of the crusted product occurs by the outward axial displacement. The initial rotating movement tends to loosen previously crusted product from the screw cap part by virtue of the retention action of the surface configuration of the stopper. The cam track and follower portion also become effective to move the screw cap part axially outwardly after the cap part is turned through an angle essentially in excess of 20°. The arrangement is such that the loosening of the previously-crusted product by the initial rotating movement, and the axially-outward movement of the screw cap part effect a dislodgement of hardened product both from the exterior surface of the screw cap part and from the stopper, thus greatly facilitating subsequent dispensing operations.

Other features and advantages will hereinafter appear.

Figure 1:
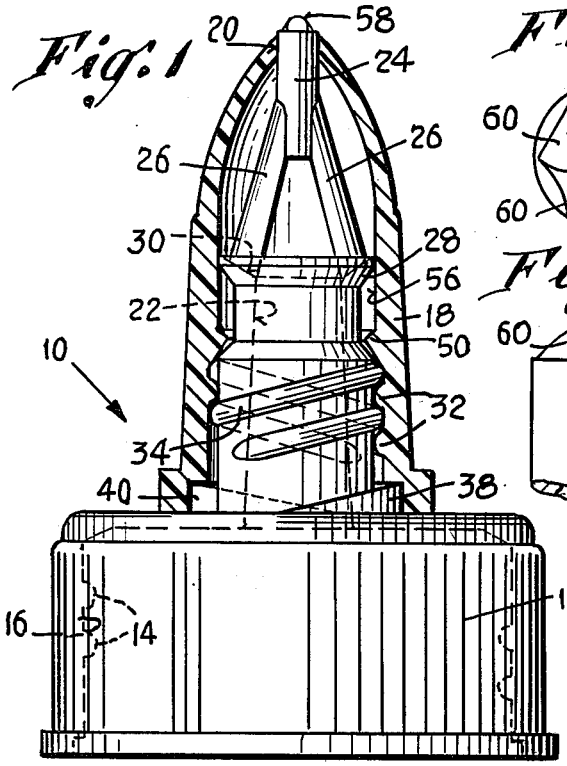
FIG. 1 is a side elevational view of the cap body part of the construction, with the screw cap part shown in axial section.
Figure 8:
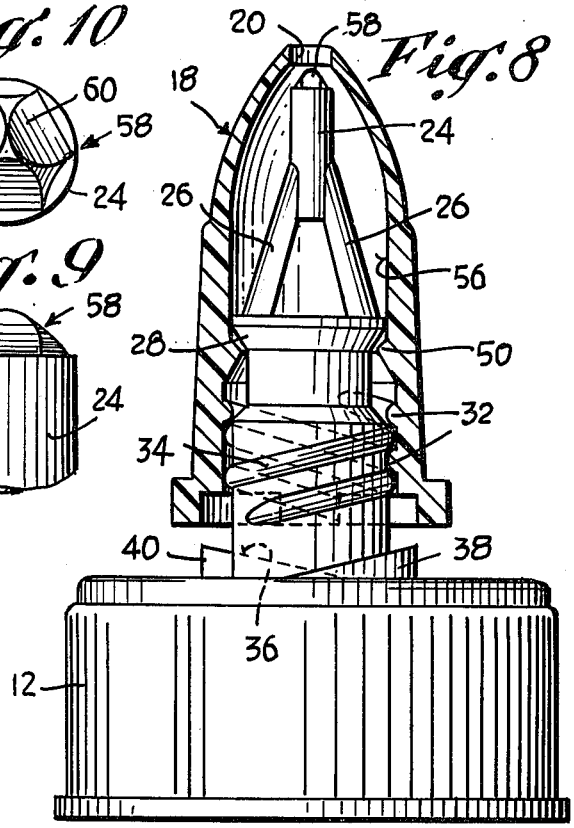
FIG. 8 is a view like FIG. 1, except showing the screw cap part having been unscrewed, and being disposed in the dispensing position.

Referring first to FIGS. 1 and 8, there is illustrated a dispensing cap construction for a container, the cap construction being generally designated by the numeral 10 and comprising a tubular body part 12 which has internal screw threads 14 on a depending flange 16, which are adapted to engage cooperable threads on the nack of a container (not shown). Carried on the tubular body part 12 is a screw cap part 18 having a discharge passage 20. The body part 12 has a hollow bore 22, and an upstanding stopper 24 which is supported by means of a series of legs 26. The body part 12 has a shoulder 28, and adjacent thereto is a generally conical drain surface 30 which enables liquid product in the vicinity of the legs 26 to flow, by gravity, back into the container.

Figure 6:
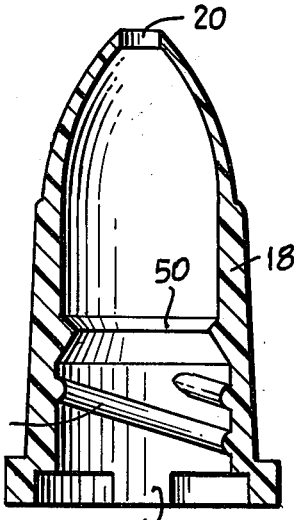
FIG. 6 is an axial section of the screw cap part, taken on line 6—6 of FIG. 5.
Figure 4:
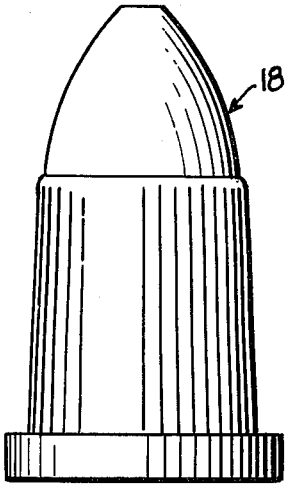
FIG. 4 is a side elevational view of the scraw cap part.
Figure 3:
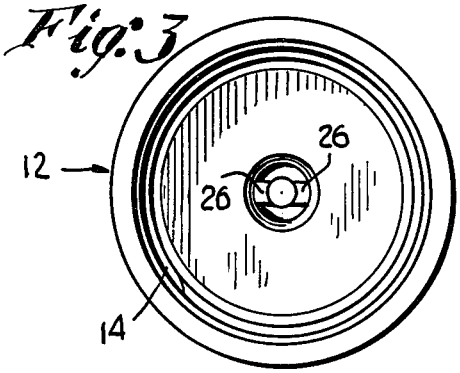
FIG. 3 is a bottom plan view of the body part.
Figure 7:
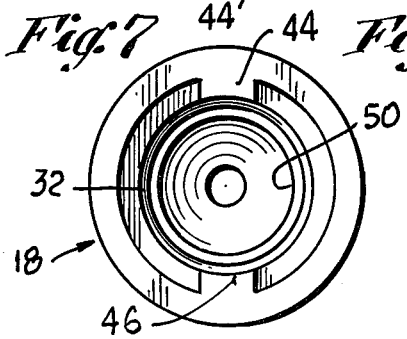
FIG. 7 is a bottom plan view of the screw cap part.
Figure 5:
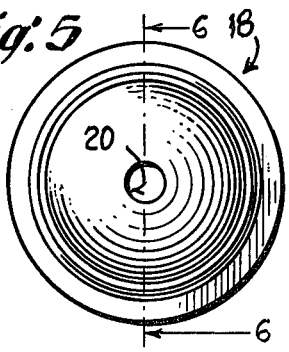
FIG. 5 is a top plan view of the screw cap part.

In accordance with the present invention, the screw cap part 18, and body part 12 have two pairs of mutually engageable portions, one pair comprising cooperable thread means 32, FIG. 6, on the interior surface of the cap part 18, and thread means 34 on the exterior surface of the body part 12, for effecting axial movement of the cap part 18 in response to turning thereof. In addition, there are provided on the body part 12, two diametrically-opposed cam tracks 36, 38, each of which extends substantially through an angle of 180°. The cam tracks 36, 38, terminate in shoulders 40 42, respectively, which constitute stops for a pair of lugs 44, 46, respectively, FIG. 7, on the underside of the cap part 18. As can be readily understood, during screwing-on movement of the cap part, the lugs 44, 46, respectively, engage the shoulders 40, 42, thereby halting the screwing-on movement of the cap at its intended, fully-on position.

Figure 2:
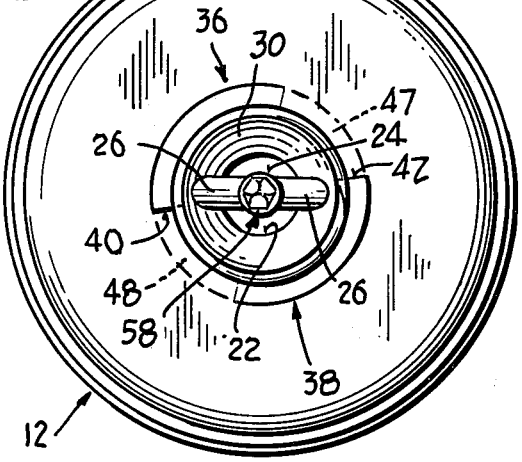
FIG. 2 is a top plan view of the body part.

Also, during the unscrewing movement of the cap part 18, the lugs 44, 46, are seen to cooperate with the cam tracks 36, 38, to thereby positively force the cap part 18 in an axially outward direction. However, by the present invention, each of the cam tracks 36, 38, has first portions 47, 48, respectively, which are of zero pitch, that is, these portions 46, 48, lie in a plane which is substantially perpendicular to the axis of the dispensing cap construction. The portions of zero pitch are shown in dotted outline in FIG. 2. The remaining portions of these tracks 36, 38 are spiral, as shown in solid outline.

In addition, by the present invention, there exists sufficient intentional backlash between the thread means 32, 34, such that the cap part, when unscrewed from the fully-on position, can undergo rotation through an angle on the order of 20° or more, before either the thread means 32, 34, or the cam tracks 36, 38, begin to shift the cap part 18 in an axially outward direction. In other words, the thread means 32, 34 are operative in order to screw the cap part 18 from a raised position as shown in FIG. 8, to the fully-seated position shown in FIG. 1. However, there is sufficient backlash between the thread means 32, 34, such that during unscrewing movement, they do not effect any significant outward movement of the cap part 18, but instead merely enable the part 18 to rotate through a small angle on the order of 20° or more, until such time as the lugs 44, 46, begin to ride up the spiral portions of the cam tracks 36, 38. Thus, the tracks 36, 38 preferably effect the inital outward axial movement of the cap part during unscrewing movement.

Referring again to FIG. 1, it can be seen that the inner surface of the cap part 18 is provided with a shoulder 50, which is intended to engage the shoulder 28 when the cap is unscrewed. By the time that such engagement occurs, the lugs 44, 46, are no longer riding on the cam tracks 36, 38, but instead the thread means 32, 34 are active, moving the cap part 18 axially outward. It can be readily understood that the engagement of the shoulders 50, 28, prevents the cap part 18 from being completely removed from the body 12. Continued unscrewing movement of the cap part 18 will merely cause the thread means 32, 34 to "strip" past one another, such thread means being sufficiently resilient to enable the stripping to occur without permanent damage or deformation thereof.

It is noted that the shoulder 28 forms a sliding seal with the inner surface 56 of the cap part 18, during axial movement thereof, so as to inhibit the leakage of liquid product into the area adjacent the thread means 32, 34.

FIG. 1 shows the cap construction in the storage or non-dispensing position, wherein the stopper 24 occupies the discharge passage or opening 20 of the cap part 18. FIG. 8 illustrates the dispenser in the discharge position, wherein the cap part 18 has been unscrewed, thereby exposing the discharge opening 20, and enabling product to flow through the bore 22, into the space between legs 26, past the stopper 24, and out the opening 20.

Figure 10:
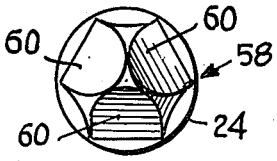
FIG. 10 is a top plan view of the stopper of FIG. 9.
Figure 9:
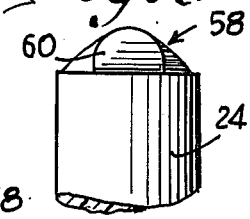
FIG. 9 is a fragmentary view, enlarged, of the stopper of the body part.

Further in accordance with the present invention, and as shown in FIG. 9 the tip 58 of the stopper 24 has a textured, or non-uniform dome-shaped configuration. This may take the form of small faces or multiple facets 60 on the tip 58, the purpose of which will be explained below. The faces 60 have arcuate or curved borders which adjoin each othar and are separated by small triangular areas, as seen in FIG. 10.

Assuming that the dispenser has been used several times, and further that a glue or glue-like substance is being dispensed, after the first few operations there will likely occur a build-up of hardened or crusted product on the exterior surface of the cap part 18 adjacent the location of the discharge opening 20. In many cases, this crusted product will adhere to the surface of the cap 18, and form a dome over the tip 58 of the stopper 24. In prior constructions involving a tip 58 that was smooth, there was a tendency for hardened product to merely be lifted off the tip 58 and remain adhered to the cap part 18, thus covering up the discharge passage 20. The tendency for a dome to form occurred even though the cap part 18 was shifted axially outward.

By the present invention, with the tip 58 having a textured configuration there is a more pronounced tendency for hardened product to adhere to this tip. Accordingly, during the initial unscrewing operation wherein the cap part 18 does not undergo any substantial axially outward movement for the first 20° or so of rotation, a breakage of the dome tends to occur, since part of the hardened product clings to the tip 58, whereas other areas of the product are clinging to the part 18. I have found that this construction tends to break up the dome, and eliminate the need for clearing the passage 20 by means of a flicking operation by the nail of the user, or with the use of a suitable tool. That is, during initial rotation of the cap 18, the dome is broken apart. Thereafter, when the lugs 44, 46 ride up the spiral portion of the cam tracks 36, 38, the broken dome tends to fall off, leaving a generally clear area around the discharge passage 20.

By the present organization, there is thus achieved a significantly improved product, in that there is a substantially reduced tendency for hardened product to cling to the cap part 18, and block the discharge opening 20.

Following use, as the container is placed in an upright position, any residual liquid product on the underside of the cap part 18 and in the vicinity of the legs 26, can drain back on the conical surface 30, and re-enter the container. Thus, there is greatly minimized the tendency for product to collect at the underside of the cap part 18, and possibly interfere with subsequent dispensing operations.

In addition to the advantages noted above, the present construction is seen to be especially simple, requiring only two separate molded pieces which can be economically fabricated in simple mold cavities. Assembly is facilitated by the use of automatic capping equipment. During such assembly, the shoulders 50, 28 are forced past one another, these being resilient, and enabling this to occur without permanent damage or deformation to either part.

The provision of the cam tracks insures that a positive outward movement is imparted to the cap part, resulting from the engagement of the lugs 44, 46. Such positive forcing of the cap part insures that hardened product will tend to be dislodged from both the cap parts and stopper, as described above.

The present construction has been found to be especially effective when employed with water-based glues, and wherein the plastic of which the cap parts and body parts is fabricated is of a type which is not subject to dissolving. Thus by the present arrangement there is virtually eliminated the need for periodic cleaning of the passage 20, and as a result the operation and use of the dispenser is greatly facilitated.

Another embodiment of the invention is illustrated in FIGS. 11–16, showing a cap construction 70 having a tubular body 72 and a screw cap part 74 with a discharge passage 76. The body part has a hollow bore 78 and an upstanding stopper 80 supported on multiple legs 82. The body part has a shoulder 84 and a drain surface similar to that indicated in FIG. 1 by the numeral 30, to enable residual liquid in the vicinity of the legs 82 to flow, by gravity, back into the container.

Cooperable thread means 86, 88 on the body part and cap part are provided, and a single cam track 90 (FIG. 12), which extends through an angle of somewhat less than 360°. The cam track 90 has a first stop shoulder 92 which is adapted to be engaged by a lug 94 on the underside of the cap part 72. In addition and as particularly shown in FIGS. 11 and 12, by the present invention the cam track 90 has a portion of zero pitch, this portion being indicated by the numeral 98 and lying in a plane Which is substantially perpendicular to the axis of the dispensing cap construction. The portion 98 of zero pitch extends through an angle on the order of 20° or so.

In addition, a second stop shoulder 100 is provided for engagement by the lug 94 of the cap part 74 during unscrewing movement, the engagement of the shoulder 100 and lug 94 preventing unscrewing movement of the cap part 74 beyond a certain angular position.

As in the previous embodiment, there exists between the thread means 86, 88, sufficient intentional backlash such that the cap part 74 can undergo rotation through an angle on the order of 20° or more, before either the thread means 86, 88 or the cam track 90 and lug 94 begin to shift the cap part 74 in an axially outward direction. That is, when the cap part 74 is initially turned from a position wherein the lug 94 engages the shoulder 92, the cap part 74 can rotate through 20° or so before the lug 94 begins to travel up the track 90.

Figure 11:
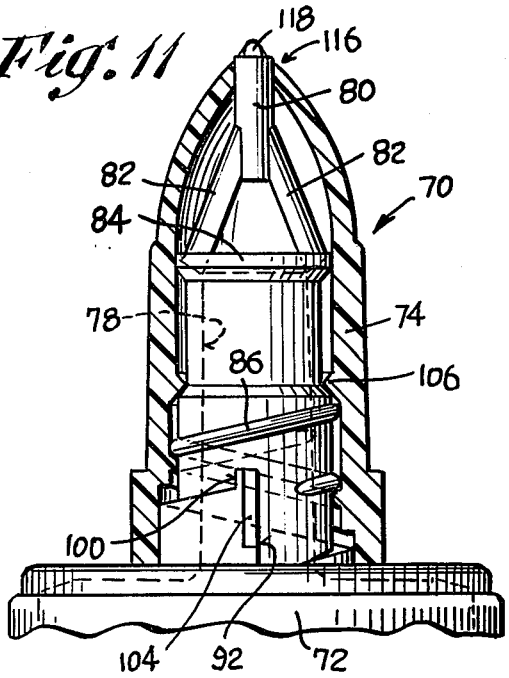
FIG. 11 is a side elevational view of a somewhat modified cap construction, constituting another embodiment of the invention.
Figure 12:
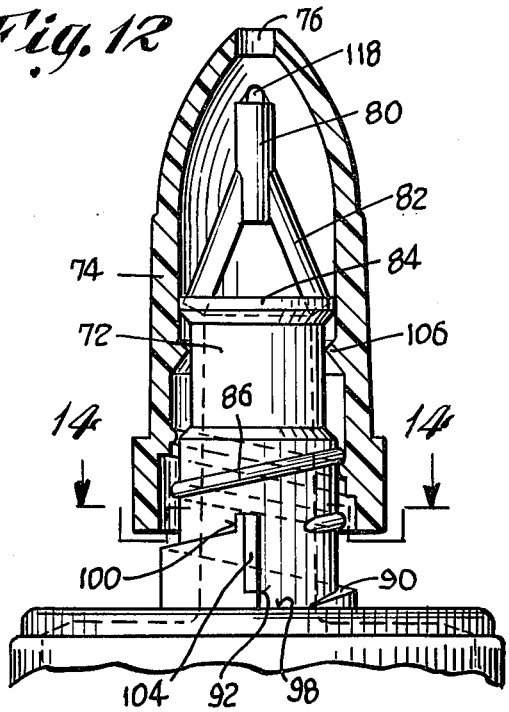
FIG. 12 is a view like FIG. 11, except showing the screw cap part having been unscrewed, and being disposed in the dispensing position.
Figure 13:
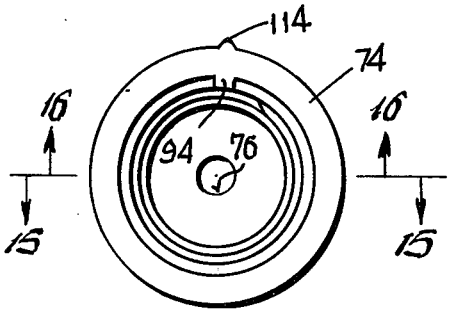
FIG. 13 is a bottom view of the screw cap part.
Figure 14:
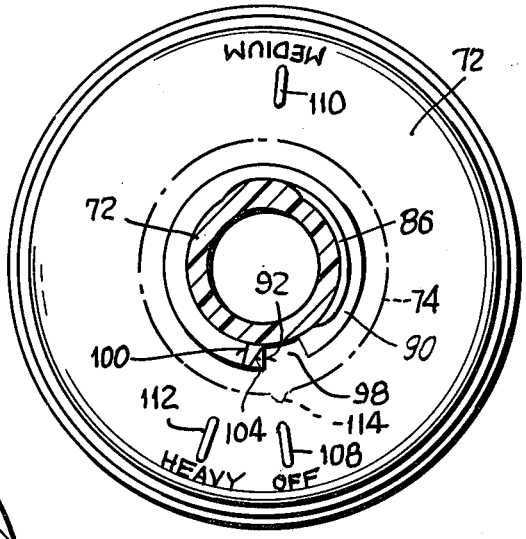
FIG. 14 is a section taken on the line 14—14 of FIG. 12.
Figure 15:
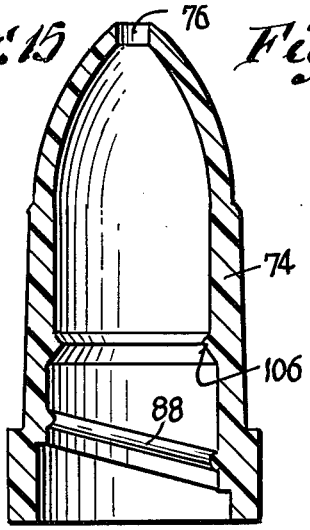
FIG. 15 is a vertical section of the screw cap part.
Figure 16:
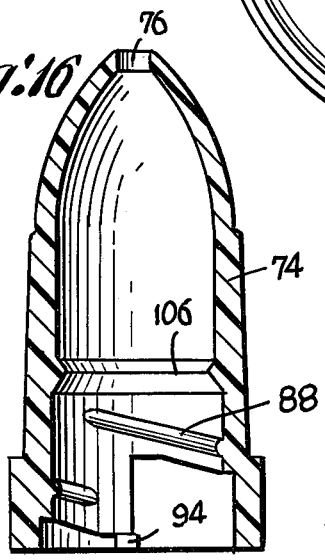
FIG. 16 is a vertical section of the screw cap part, taken 180° from the position of FIG. 15.

In addition, as shown in FIGS. 11, 12 and 14, the body part 72 has a beveled surface 104 which enables the lug 94 to be cammed in a radially outward direction during assembly of the cap part, the latter being sufficiently resilient to enable such outward camming to occur. This is important where automatic capping equipment is employed, in insure smooth, jam-free operation. As in the previous embodiment, the inner surface of the cap part 74 has an annular shoulder 106 which can engage the shoulder 84 when the cap is unscrewed, to limit its axially outward movement, so as to prevent the cap part 74 from being completely removed from the body part 72. In addition, the shoulder 106 on the cap part 74 can ride on and seal with the cylindrical surface indicated at 72 in FIG. 12, of the body part 72.

Calibrating indicia 108, 110, and 112 are provided on the upper surface of the body part 72 (FIG. 14), together with a small bead 114 on the outer surface of the cap part 74. Such an arrangement enables the user to more readily orient the cap part 74 With respect to the body part 72, and provides an indication of the axial position of the cap part. For instance, as shown in FIG. 14, the cap part 74 would be disposed in its fully screwed on position, corresponding to a "closed" condition, as in FIG. 11. Similarly, in FIG. 14 with the cap part 74 rotated such that the bead 114 would align with the marker 112, the cap part 74 would occupy the position shown in FIG. 12, corresponding to a fully opened condition. A partially opened condition would occur where the bead 114 was aligned with the marker 110.

By the present invention, the tip 116 of the stopper 80 has multiple faces or facets 118, these tending to cause any crusted product to initially adhere to the tip 116. The advantage of this construction is set forth adequately in the description of the embodiment of FIGS. 1–10 and accordingly need not be repeated.

Accordingly, the present cap constructions are seen to represent distinct advances and improvements in the technology of dispensing closures.

Variations and modifications are possible without departing from the spirit of the invention.

What is claimed is:

1. A captive dispensing cap construction comprising, in combination:

(a) a tubular body part adapted to be carried by a container and having a discharge psssage, said body part having a stopper extending upwardly from said passage, (b) a screw cap part carried by said body part and surrounding said discharge passage, (c) said screw cap part having a discharge opening into which the stopper extends when the screw cap part is screwed to its full-on position on the body part, (d) said screw cap and body parts having two pairs of mutually engageable portions, (e) one pair of mutually engageable portions comprising cooperable screw thread means respectively on said parts, for moving the screw cap part axially on the body part as the screw cap part is turned, (f) a lug disposed on the screw cap part, (g) a stop shoulder on the body part, engageable with the lug of the screw cap part to halt turning of the latter as it is screwed to its full-on position, (h) the screw thread means of the screw cap and body parts having sufficient backlash to enable the screw cap part to have an initial unscrewing turning movement from its fully screwed-on position without outward axial displacement, through an angle essentially in excess of 20° before tending to cause such displacement, (i) said stopper having an exposed surface configuration which tends to retain hardened or crusted product against dislodgement during the said initial rotating movement, until a forcible removal of the crusted product occurs by said outward axial displacement, (j) the said initial rotating movement tending to loosen previously crusted product from the screw cap part by virtue of the retention action of said exposed surface configuration, said loosening occurring prior to any outward axial movement of the screw cap part, (k) said other pair of mutually engageable portions comprising a cam track on the body part and a follower portion on the screw cap part, (l) said cam track and follower portion becoming effective to move the screw cap part axially outwardly in response to the latter being turned through an angle essentially in excess of 20°, (m) said loosening of the previously-crusted product by the initial rotating movement, and the axially-outward movement of the screw cap part effecting a dislodgment of said product both from the exterior surface of the screw cap part and from the stopper.

2. The invention as defined in claim 1, wherein:

(a) said cam track has a first portion which lies in a plane substantially perpendicular to the axis of the screw cap part, and a second portion of spiral configuration, (b) the screw cap part not experiencing any substantial movement in an axial direction as the follower portion of the screw cap traverses the said first portion of the cam track, until it arrives at the spiral portion thereof.

3. The invention as defined in claim 1, wherein:

(a) said other pair of mutually engageable portions comprises a second cam track on the body part, disposed substantially 180° from the first cam track, (b) a second follower portion on the screw cap part, disposed diametrically opposite the first follower portion and adapted to traverse the second cam track

4. The invention as defined in claim 3, wherein:

(a) said second cam track has a portion which lies in a plane substantially perpendicular to the axis of the screw cap part.

5. The invention as defined in claim 1, wherein:

(a) the engagement of the follower and the cam track positively shifts the cap part axially outwardly following turning of the cap part through an angle in excess of 20°.

6. The invention as defined in claim 1, wherein:

(a) said stopper has a surface configuration characterized by adjoining facets to which hardened product tends to cling.

7. The invention as defined in claim 1, wherein:

(a) said stopper has a non-smooth surface configuration to which hardened product tends to cling.

8. The invention as defined in claim 1, wherein:

(a) said discharge passage has a generally annular drainback portion, allowing product adhering to the inner surface of the screw cap part to flow by gravity back into the container when the latter is placed in an upright position.

9. The invention as defined in claim 1, wherein:

(a) said body part and screw cap part have cooperable retainer shoulders engageable with one another when the screw cap part is unscrewed past a certain point, in order to retain the screw cap part on the body part.

10. The invention as defined in claim 9, wherein:

(a) at least one of said cooperable retainer shoulders is deformable, in order to enable the cap part to be forced into the body part during assembly. axial movement, (f) the said initial rotating movement tending to loosen previously crusted product from the screw cap part by virtue of the retention action of said exposed surface configuration.

11. The invention as defined in claim 9, wherein:

(a) the body part has a generally cylindrical bearing surface below its shoulder, (b) the shoulder of said cap part being slidable on the bearing surface of the body part during unscrewing movement of the cap part, (c) said cap part shoulder and bearing surface forming a slidable seal which prevents leakage of product.

12. The invention as defined in claim 1, wherein:

(a) said cam track comprises a single track extending substantially through an angle of just less than 360°.

13. The invention as defined in claim 12, and further including:

(a) an additional stop shoulder on the body, engageable with the lug of the screw cap part as the latter is unscrewed, to prevent inadvertent removal of the screw cap part from the body part.

14. The invention as defined in claim 12, and further including:

(a) means providing a beveled surface on the cam track of the body part of the cap construction, to facilitate by-pass of the stop shoulder on the body part by the stop lug of the cap part, during assembly of the latter, (b) said lug being forcible past the beveled surface of the body part, and said cap part being deformable in a radially outward direction to enable such by-passing movement to occur.

15. The invention as defined in claim 12, and further including:

(a) indicating indicia on the body part and cap part to indicate to the user the relative rotational and axial positions of the cap part with the respect to the body part.

16. A captive dispensing cap construction comprising, in combination:

(a) a tubular body part adapted to be carried by a container and having a discharge passage, said body part having a stopper extending upwardly from said passage, (b) a screw cap part carried by said body part and surrounding said discharge passage, (c) said screw cap part having a discharge opening into which the stopper extends when the screw cap part is screwed to its full-on position on the body part, (d) said screw cap and body parts having two pairs of mutually engageable portions, (e) one pair of mutually engageable portions comprising cooperable screw thread means respectively on said parts, for moving the screw cap part axially on the body part as the screw cap part is turned, (f) a lug disposed on the screw cap part, (g) a stop shoulder on the body part, engageable with the lug of the screw cap part to halt turning of the latter as it is screwed to its full-on position, (h) the screw thread means of the screw cap and body parts having sufficient backlash to enable the screw cap part to have an initial unscrewing turning movement from its fully screwed-on position without outward axial displacement, through an angle essentially in excess of 20° before tending to cause such displacement, (i) said other pair of mutually engageable portions comprising a cam track on the body part and a follower portion on the screw cap part, (j) said cam track having a first portion which lies in a plane substantially perpendicular to the axis of the screw cap part, and a second portion of spiral configuration, said cam track and follower portion becoming effective to move the screw cap part axially outwardly in response to the latter being turned through an angle essentially in excess of 20°, as the follower portion leaves the first portion of the cam track and engages the second portion thereof.

* * * * *